United States Patent [19]

Zumsteg

[11] 4,193,285

[45] Mar. 18, 1980

[54] METHOD OF DEEP-DRAWING OF A CONTAINER OR THE LIKE FROM AN ALUMINIUM MATERIAL

[75] Inventor: Horst Zumsteg, Rorschacherberg, Switzerland

[73] Assignee: Alcan Research and Development Limited, Montreal, Canada

[21] Appl. No.: 914,964

[22] Filed: Jun. 12, 1978

[30] Foreign Application Priority Data

Jun. 15, 1977 [CH] Switzerland ..... 7379/77

[51] Int. Cl.[2] ..... B21D 22/00

[52] U.S. Cl. ..... 72/348; 113/120 AA

[58] Field of Search ..... 72/347-350; 113/120 AA

[56] References Cited

U.S. PATENT DOCUMENTS

| | | | |
|---|---|---|---|
| 2,075,847 | 4/1937 | Nathensoll | 72/348 X |
| 2,761,406 | 9/1956 | Schnell | 72/349 |
| 3,452,396 | 7/1969 | Garver et al. | 72/347 X |
| 3,685,338 | 8/1972 | Hoffman | 72/348 |
| 3,844,154 | 10/1974 | Bozek | 72/350 |

FOREIGN PATENT DOCUMENTS 550635 1/1943 United Kingdom .

*Primary Examiner*—Leon Gilden

*Attorney, Agent, or Firm*—Cooper, Dunham, Clark, Griffin & Moran

[57] ABSTRACT

A method of and apparatus for producing a container or the like by deep-drawing a flat blank of a sheetlike aluminium material. The blank is deep-drawn by means of a first drawing stroke into a cylindrical container blank and brought into its final shape by means of a counter drawing stroke, whereby the inner wall and outer wall of the cylindrical container maintain their positions. The apparatus comprises two telescoping dies with oppositely directed working strokes, between which dies there is arranged at least one drawing ledge.

5 Claims, 4 Drawing Figures

P1
P2
P3
10
4
29
8
31
6
32
5
7
9
30
3
1
19
2
11
18
13
53
52
17
12
14
20
16
15
51
22
49
43
46
42
44
47
45
21
50
48
33
28
27
38
34
39
36
37
35
41
24
55
54
56
23
20
40

METHOD OF DEEP-DRAWING OF A CONTAINER OR THE LIKE FROM AN ALUMINIUM MATERIAL

BACKGROUND OF THE INVENTION

1. Field of the Invention

The present invention relates to an improved method of producing a container or the like by deep-drawing a flat blank of a sheetlike aluminium material and to an apparatus for deep-drawing a flat blank of an aluminium metal sheet into an aluminium container or the like.

2. Description of the Prior Art

These are known several techniques of deep-drawing in the art, by means of which drawing ratios of $\beta=2$ can be achieved by one single working stroke of the press. Such known techniques are for instance the Auble process (multistep process), the simultaneous system (compound process), the inversion deep-drawing process and the sequential deep-drawing process.

All of these known processes or methods, respectively, are bestowed a common drawback in that the drawing tool necessary for carrying out any said processes demand the installation of presses incorporating extremely large strokes, which demand originates from the prevalence of two sequentially carried out process steps.

For instance, the production or shaping, respectively, of a can having a depth of 70 mm calls for a minimal stroke of the press at the first drawing stroke of 60 mm, at the second drawing stroke a press stroke of 70 mm, for the opening of the drawing tool and subsequent ejection of the can produced 100 mm, thus total 230 mm. Now, deep-drawing presses for the production of aluminium cans and the like commonly available on the market feature in general a stroke of 140–220 mm. Therefore, it is not possible to mount tools or such presses which are necessary for producing cans with a depth of 70 mm. Conclusively, it is necessary to install a custom-made press of special design which however from the viewpoint of capital investment and power consumption is not attractive.

A further drawback is the fact that due to the large or high, respectively, stroke necessary for the production of such deep cans the relative plunger or ram speed is extremely high, following in the deep-drawing tool being heavily stressed which leads to a considerable reduction of its usable service life.

Furthermore, the commonly known inversion deep-drawing process involves a bending of the material being drawn through an angle of 180°. Considering an aluminium sheet coated with varnish such large bending angle involves that the varnish coating is subject to injury.

SUMMARY OF THE INVENTION

Hence, it is a general object of the present invention to provide an improved method of and apparatus for deep-drawing an aluminium container or the like which allows installment of a deep-drawing tool having a reduced total working stroke compatible with the stroke of commonly available presses.

Another object aims at the provision of a new and improved method of producing a container or the like by deep-drawing a flat blank of a sheetlike aluminium material manifested by the features that the sheetlike blank is deep-drawn by a first draw into a cylindrical container blank and drawn further by a counter draw into its final shape, whereby the positions of the inner and outer surfaces of the container blank remain unchanged.

A further object is to provide a method of producing a container or the like of an aluminium material by deep-drawing a flat blank of an aluminium material manifested by the features that there are provided two telescoping die means having oppositely directed working strokes, between which said die means there is arranged at least one drawing ledge means, whereby said blank is deep-drawn by means of a first working stroke to a cylindrical container blank and by means of a counter working stroke being shaped into its final form, whereby the relative positions of the inner wall surface and the outer wall surface of said cylindrical container blank remain unchanged.

Yet a further object aims at the provision of a new and improved construction of an apparatus for deep-drawing a flat blank of an aluminium metal sheet into an aluminium container or the like manifested by the features that there are provided two telescoping die means and at least one drawing ledge means, whereby said drawing ledge means is arranged between said two die means, and whereby said two die means feature oppositely to each other directed working strokes.

It thus follows that the installed height of double stroke tools can be decreased such that commonly available deep-drawing presses can be utilized doing away with the need of custom-made presses. Accordingly, the stroke of the press can be decreased such that the deep-drawing tools can be operated at higher speeds or number of strokes, respectively, that hitherto was possible without impairing the service life thereof. Also, it is possible that the blank strip being shaped into a container or the like is bent only by an angle of 90° instead of 180°.

Because now according to the invention the positions of the inner wall surface and outer wall surface of the container blank remain unchanged during the execution of the counter stroke, this in contrast to the commonly known inversion deep-drawing processes involving a change of the direction of flow of the material drawn, it is now possible to process blanks carrying already a coating of varnish. The cylindrical container blank shaped by the first stroke comprises a container inner wall surface and a container outer wall surface. During the second draw said inner wall surface and said outer wall surface maintain each their position. In other words, the outer wall surface of the cylindrical container blank will form the outer wall surface of the final product having e.g. the shape of a truncated cone, and the inner wall surface of the container blank will form the inner wall surface of the final product. It is commonly known that at the known inversion deep-drawing process the inner wall surface of the blank will form the outer wall surface of the final product, e.g. container, cup and the like, whereby the outer wall surface of the blank will form the inner wall surface of the final product.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DETAILED DESCRIPTION OF THE PREFERRED EMBODIMENT

Figure 1:
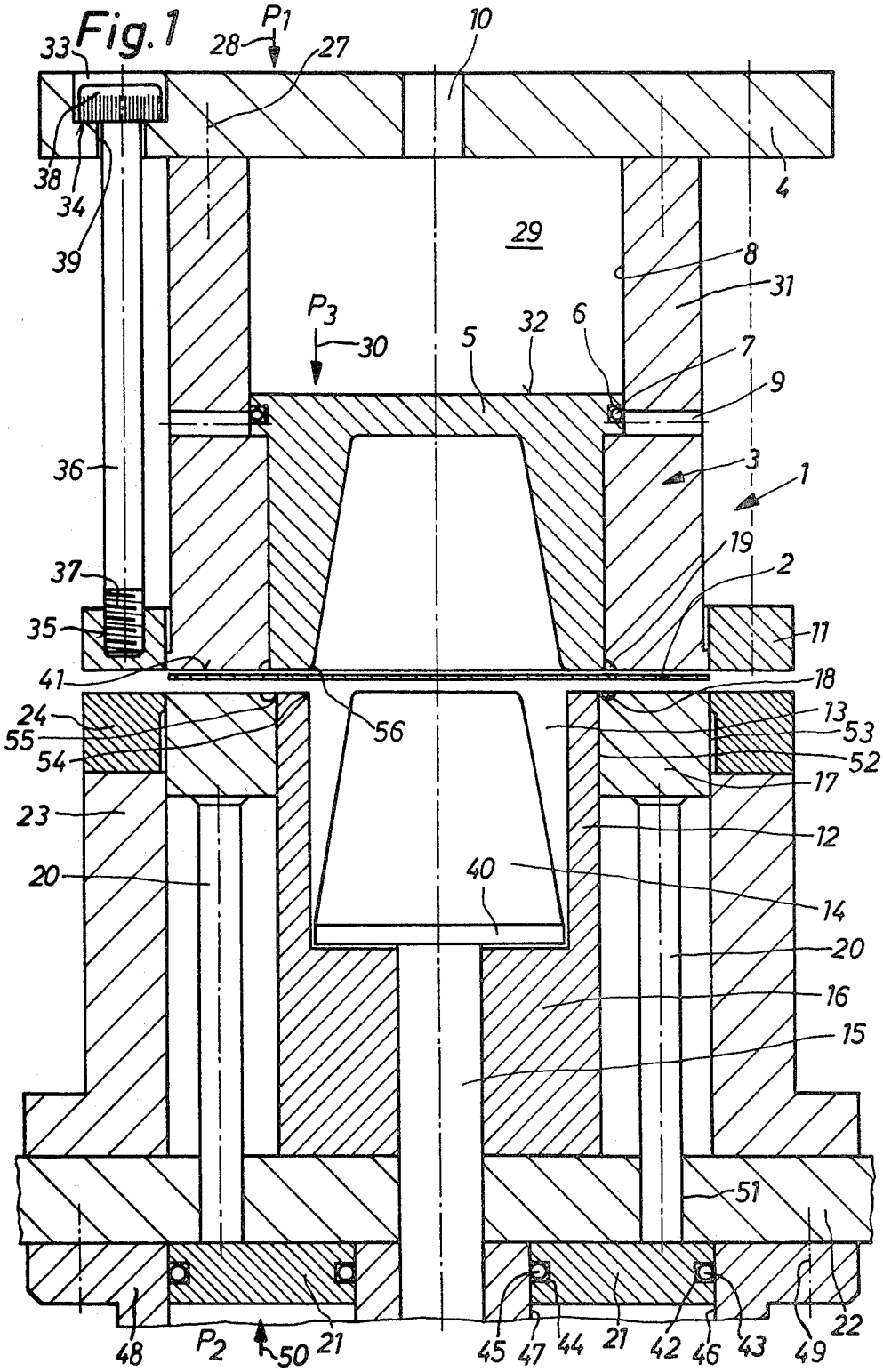
FIGS. 1–4 are views of a vertical section through the preferred embodiment of the inventive tool, whereby the relative positon of its various elements are shown at four consecutive operational steps.

Considering now the drawings there is shown in FIG. 1 a vertical section through a deep-drawing tool applied in the production of aluminium cans or containers or similar products, which deep-drawing tool is generally identified by the reference numeral 1. This tool is shown in FIG. 1 in a position of its structural elements at which a fresh or new blank 2 to be drawn, such as an aluminium metal sheet or a ronde, respectively, has been inserted by commonly known means into said tool 1 such to be subsequently deep-drawn.

The deep-drawing tool is provided with a die 3 in the form of a hollow cylinder or sleeve, respectively. This die 3 is mounted on a frame portion 4 by the agency of screwed joints indicated generally at 27, which frame portion 4 forms together with frame portion 22 part of a die block or column mount of a drawing press, whereby the latter elements are not particularly shown and described because they are well known to a person skilled in the art. The other elements of the tool 1, which elements will be described as the description proceeds, are also mounted to said frame 4 or 22, respectively. Said frame portion 4 is driven by the drawing press in a known manner, thus a pressurized fluid is exerting a pressure force P1 acting in the direction identified by the arrow 28 onto said frame portion 4, such that the latter is subject to a pressure P1. In the interior space 29 of said cylindrical die 3 there is arranged a press pad 5 featuring the shape of an inverted cup, which press pad 5 is axially movable together with said die 3. This cup-shaped press pad 5 is acted upon by a pressurized fluid exerting a force P3 acting in the direction of arrow 30. This press pad 5 acts or operates, respectively, also as a bottom die such as will be described as the description proceeds. The press pad 5 is provided with an outer circumferential groove 6 into which there is inserted an annular sealing member 7 which sealingly engages the inner wall surface 8 of the sleeve-like or cylindrical die 3. The side walls 31 of die 3 are provided with a plurality of through bores 9 for venting or discharging, respectively, any liquid matter which may be trapped under press pad 5. The frame portion 4 is provided with a centrally arranged through bore 10 defining an inlet channel for the pressurized fluid producing the pressure P3, which fluid acts upon the upper face 32 of press pad 5. The sleeve-like or cylindrical, respectively, die 3 is guided in a known manner in a column mount not particularly shown. Furthermore, there is shown in FIG. 1 an annular ring-like member 11, which acts as stripper plate of the stamped metal part or stamped grid, respectively. The frame part 4 is provided with a plurality of stepped through bores 33 defining a shoulder 34 each. The ring 11 is provided with tapped blind holes 35 at locations corresponding to the locations of the above mentioned through bores 33. In each of said through bores 33 there is inserted a rod 36 having a threaded end section 37 and oppositely thereof a knurled head 38. It is to be noted that the inner diameter of the narrower section 39 of the through bore 33 is slightly larger than the outer diameter of the rod 36, such that each rod 36 is guided for longitudinal movement in each of said through bores 33.

The deep-drawing tool 1 is provided further with a stationary drawing die 12. This stationary die 12 comprises a recess 13, in which recess 13 there is arranged a further movable drawing die 14. The stem 15 of die 14 extends through the lower section 16 of the stationary die 12. The body of die 14 features the shape of a truncated cone having a lower cylindrical portion 40 of a diameter slightly smaller than the inner diameter of the cylindrical recess 13.

An annular drawing die 17 is arranged extending oppositely to the face 41 of the sleeve-like die 3. At the inner circumferential edge of this annular drawing die 17 there extends an annular claw 18. An annular recess 19 formed in the sleeve-like or cylindrical die 3 extends oppositely to the annular claw 18, whereby the function of claw 18 and recess 19 will be explained later on.

The annular drawing die 17 is rigidly mounted to a plurality of plungers 20 connected in turn to a common annular piston 21 of a not particularly shown drawing cushion or pad known to the person skilled in the art. The annular drawing die 17 is provided with an outer circumferential groove 42 in which a sealing ring 43 is received and with an inner circumferential groove 44 in which a further sealing ring 45 is received. These sealing rings 43, 45 sealingly engage the inner circumferential wall sections 46 and 47 of a cylinder 48 of the drawing cushion, which cylinder 48 is connected by means of schematically drawn screw bolts 49 to the frame portion 22.

The annular piston 21 is acted upon by a pressurized fluid exerting a pressure P2 in a direction indicated by the arrow 50. The plungers 20 extend each through a through bore 51 each arranged in the plate-like frame part 22 in which through bores 51 the respective plungers 20 are guided. The drawing die 17 is guided at its inner circumferential surface 52 in the stationary drawing die 12 and is furthermore guided at its outer circumferential surface 53 in a sleeve 23 rigidly mounted on frame part 22. The upper end of this sleeve 23 is rigidly releasably mounted to a cutting die 24.

Following, the operation of the above described embodiment of the inventive drawing tool 1 when carrying out the inventive method is described.

Attention is drawn initially to FIG. 1 of the drawings, whereby it is assumed that the blank 2 has by means known in the art and not particularly shown been brought in a correct operative position such as shown in FIG. 1. Firstly, the blank 2 is punched out between cutting die 3 and stationary cutting die 24 which is obviously achieved by a downwards movement of cutting die 3. At the same time the ring-like member 11 is placed upon the ring-like cutting die 24 and the press pad 5 exposed by the action of a known control means to the pressurized fluid exerting a pressure P3 in the direction of arrow 30 is simultaneously pressed against the blank 2.

Figure 2:
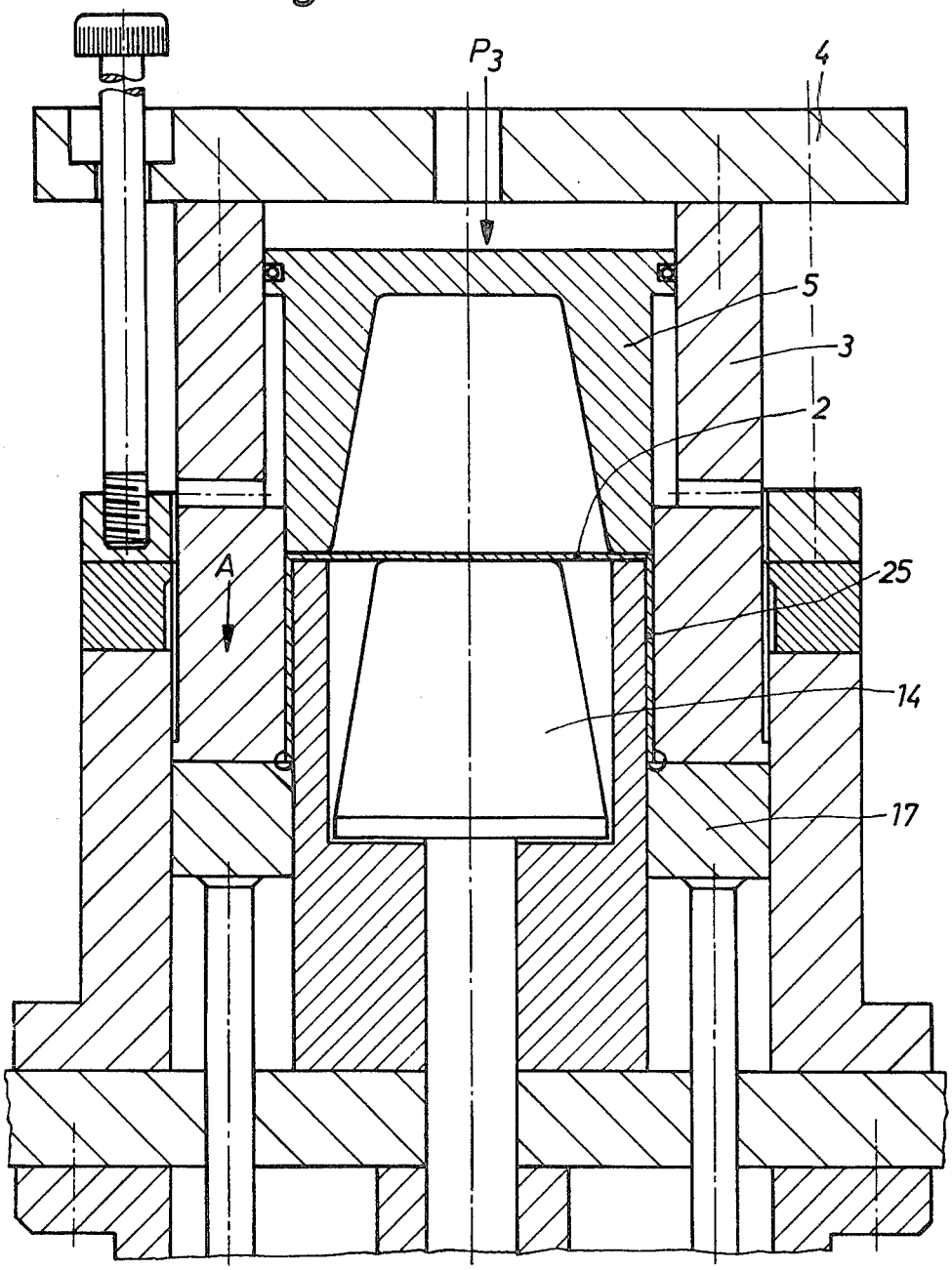

The cylindrical die 3 is now moved downwards in the direction of the arrow A; see FIG. 2. To this end the pressure P1 acting upon frame part 4 is increased, see FIG. 1, until it overcomes the force P2 acting from below onto piston 21. Thereby the blank 2 is pressed against the carrying surfaces abutting same. Accordingly, the first drawing step is initiated, whereby the upper, outer circumferential edge 54 of the stationary drawing die 12 forms a drawing ledge.

Figure 3:
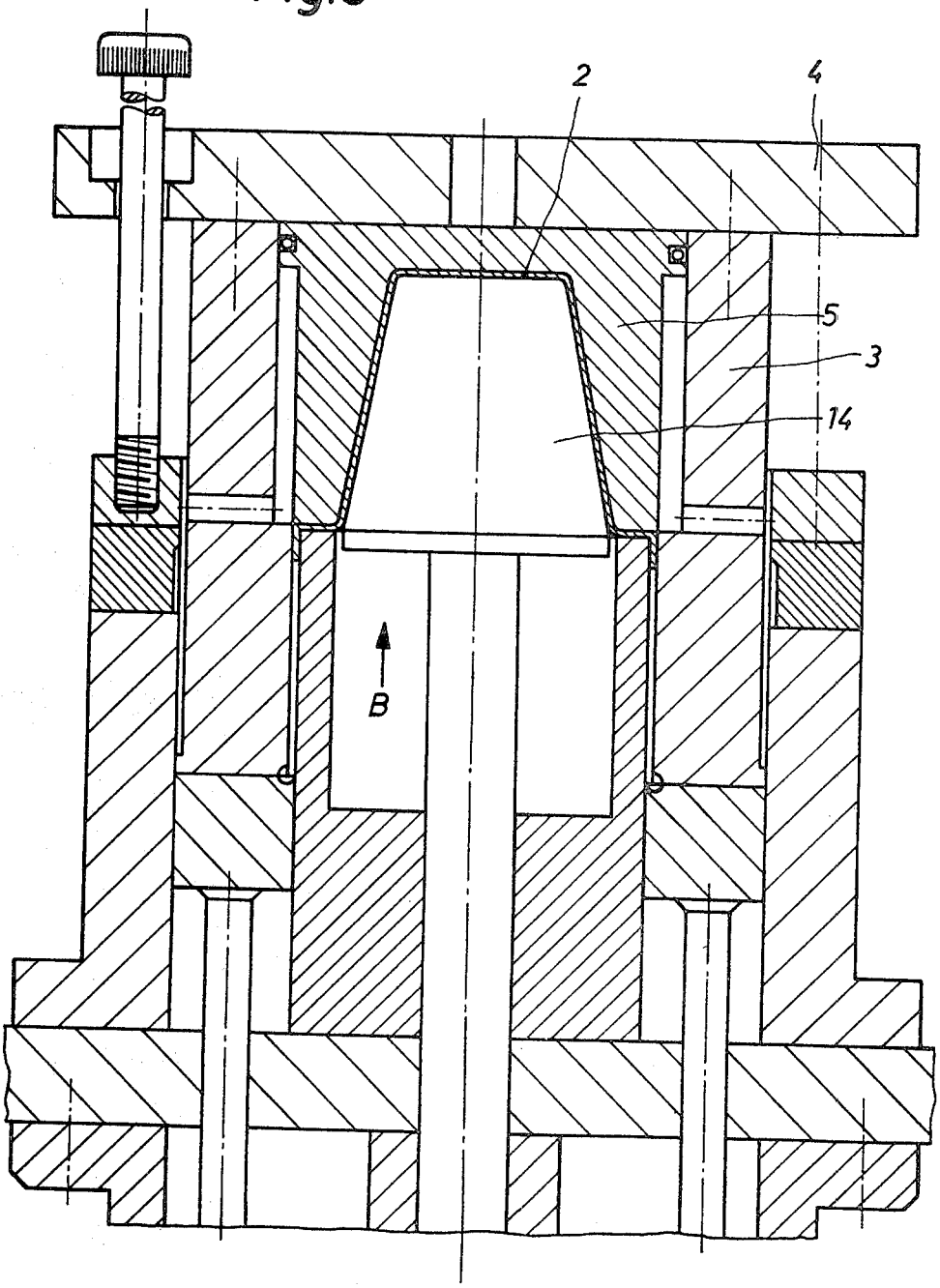
Figure 4:
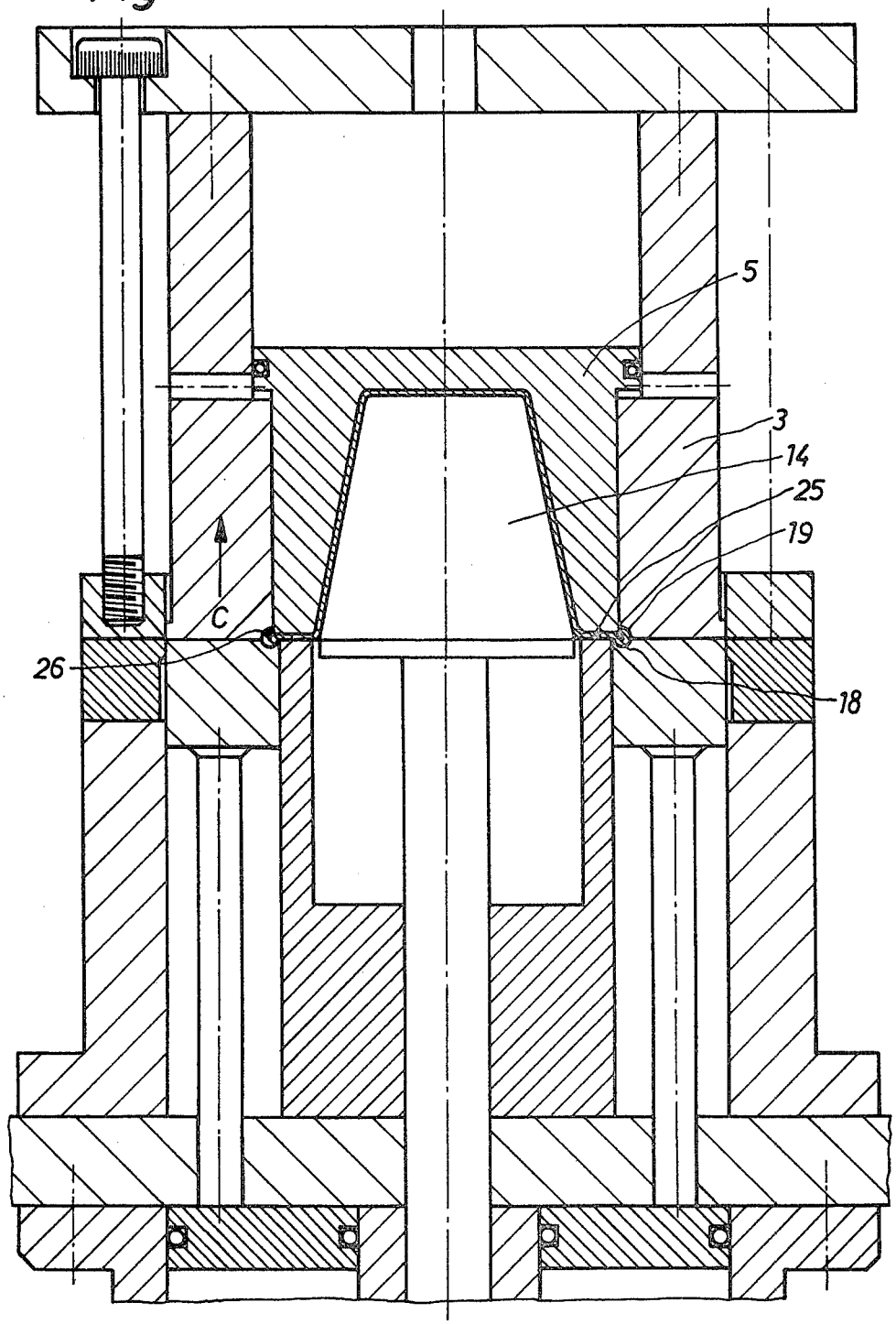

In FIGS. 2–4 several reference numbers have been deleted for ease of understanding the operation of the drawing tool. The cutting die 3 and the drawing die 17 have been lowered simultaneously, whereby the press pad 5 and the drawing die 14 maintain their respective original positions such as shown in FIG. 1. Accordingly, between the cylindrical die 3 and drawing die 12 the wall 25 of a blank, cylindrical cup-like container is drawn such that the blank 2 is shaped such as disclosed in FIG. 2.

Shortly prior to the cylindrical die 3 reaching its lower dead point the drawing die 14 is operated and begins to move in the direction of arrow B, upwards, see FIG. 3, and against the action of pressure P3 and in a direction oppositely to the direction of movement A of die 3 and enters into press pad 5. It is to be noted that the velocity of the upwards moving drawing die 14 exceeds the velocity of the downwards moving cylindrical die 3. In the embodiment shown and described the speed ratio is 4:1. By said upwards movement of the drawing die 14 the sheet metal forming the container blank is drawn upwards and accordingly forms a container or cup in the shape of a truncated cone. Thereby the upper outer circumferential edge 55 of the stationary die forms a drawing ledge and a further drawing ledge 56 is arranged at the press pad 5 acting as bottom die. During this second drawing step the press pad 5 does not abut the frame part 4 which has been the general procedure of the prior art. In the present embodiment the press pad 5 is being held or arrested exclusively by pressure P3 of the pressurized fluid against the upwards directed forces acting thereupon and produced by the drawing die 14 and by the deformation of the metal. As soon as the tool reached its lower dead point the press pad forming the or acting as the bottom die too abuts the frame portion 4. This position is shown in FIG. 3.

The final step is shown in FIG. 4. Die 3 begins to move again and moves upwards in the direction of arrow C. The annular claw 18 engages the edge 18 of the container being thus produced and forms in cooperation with the recess 19 the rolled in edge or rim portion 26 of the container. During the reverse upwards directed stroke the drawing die 14 was retracted again into the interior space 13 of the drawing die 12 and the finished product can be ejected.

Out of the drawings it is clear that during the deep-drawing the blank 2 is at no location bent by an angle of 180°. Any bend is maximal by an angle of 90°. This results however that a blank 2 having a varnish coat can be processed without said varnish coat being damaged due to an excessive bending, such as suffering the generation of pores. It is likewise obvious that the sleeve, the die and thus the total mounting height of the tool is small, such that it can be mounted without trouble into commonly available pressing or punching machines.

While there is shown and described a present preferred embodiment of the invention, it is to be distinctly understood that the invention is not limited thereto, but may be otherwise variously embodied and practiced within the scope of the following claims. Accordingly,

I claim:

1. A method of producing a container or the like having the shape of a truncated cone and a rolled-in edge portion by deep-drawing a flat blank of sheet-like aluminium metal, including the steps of (a) deep-drawing the sheet-like blank by a first draw into a cylindrical container blank and (b) further drawing said blank by a counter draw into its final shape in the form of a truncated cone, such that the positions of the inner and outer surfaces of the container blank remain unchanged, wherein the improvement comprises (c) initiating the counter draw prior to the completion of the first draw, (d) the velocity of said counter draw exceeding the velocity of the first draw.

2. A method according to claim 1, wherein said draw and said counter draw are respectively performed by a first movable die having a cylindrical inner wall defining a space and by a second movable die having an outer wall in the shape of a truncated cone, said first movable die performing said first draw by moving from an initial position, at a first velocity in a first direction along a rectilinear axis, telescopingly over a stationary hollow open-ended die member within which said second movable die is initially positioned, said second movable die performing said counter draw by moving along said axis in a second direction opposite to said first direction and a second velocity higher than said first velocity into the space defined by said inner wall of said first movable die, said first movable die and said stationary die member respectively having concentric annular edges which are disposed in facing spaced relation along said axis when said first movable die is in said initial position and between which said flat blank is initially disposed.

3. A method according to claim 1, wherein a press pad is initially disposed concentrically within the space defined by the inner wall of said first movable die, said press pad defining a recess in the shape of a truncated cone opening toward said second movable die and in register therewith, said press pad having a limited range of movement in said second direction along said axis and being normally held by fluid pressure away from the limit of its movement in said second direction, such that during said counter draw said second movable die initially draws said blank while entering said recess and moving said press pad in said second direction against said fluid pressure until said press pad reaches said limit and then irons the drawn blank by pressure against said press pad.

4. A method according to claim 1, wherein a third movable annular die initially concentrically surrounding said stationary die member is moved in said second direction along said axis after said blank is further drawn by said counter draw as aforesaid for forming a rolled-in rim on the drawn blank.

5. A method according to claim 1, wherein the velocity of said counter draw is about four times the velocity of said first draw.

* * * * *